US011020875B2

(12) United States Patent
Stefani et al.

(10) Patent No.: US 11,020,875 B2
(45) **Date of Patent: *Jun. 1, 2021**

(54) FORMING ELEMENT FOR CERAMIC ARTICLES

(71) Applicant: SYSTEM S.P.A., FIORANO MODENESE (IT)

(72) Inventors: Franco Stefani, Sassuolo (IT); Franco Gozzi, Formigine (IT)

(73) Assignee: SYSTEM CERAMICS S.P.A., Fiorano Modenese (IT)

( * ) Notice: Subject to any disclaimer, the term of this patent is extended or adjusted under 35 U.S.C. 154(b) by 369 days.

This patent is subject to a terminal disclaimer.

(21) Appl. No.: 15/773,369

(22) PCT Filed: Nov. 10, 2016

(86) PCT No.: PCT/IB2016/056764

§ 371 (c)(1),
(2) Date: May 3, 2018

(87) PCT Pub. No.: WO2017/085597

PCT Pub. Date: May 26, 2017

(65) Prior Publication Data

US 2019/0016011 A1 Jan. 17, 2019

(30) Foreign Application Priority Data

Nov. 16, 2015 (IT) ..... 102015000072879
Apr. 8, 2016 (IT) ..... 102016000036235

(51) Int. Cl.
*B28B 5/02* (2006.01)
*B28B 3/02* (2006.01)
(Continued)

(52) U.S. Cl.
CPC ..... *B28B 3/024* (2013.01); *B28B 5/021* (2013.01); *B30B 5/06* (2013.01); *B30B 11/02* (2013.01)

(58) Field of Classification Search
CPC ..... B30B 5/06; B30B 5/021; B30B 5/025; B30B 5/027; B30B 15/061; B29C 43/228; B29C 43/2043
See application file for complete search history.

(56) References Cited

U.S. PATENT DOCUMENTS 4,025,272 A * 5/1977 Camp, III ..... B30B 5/062 425/324.1
4,714,015 A * 12/1987 Stabler ..... B30B 5/062 425/371
(Continued)

FOREIGN PATENT DOCUMENTS

CN 86106484 A 4/1987
CN 1451524 A 10/2003
(Continued)

*Primary Examiner* — Joseph S Del Sole
*Assistant Examiner* — Thu Khanh T Nguyen
(74) *Attorney, Agent, or Firm* — Pearne & Gordon LLP

(57) ABSTRACT

A pressing device, comprising: a lower punch (10), provided with a pressing surface (10*a*) facing upwards; an upper punch (11), provided with a pressing surface (11*a*), facing downwards; at least one of the two punches is movable nearingly and distancingly relative to the other in order to perform pressing of a layer (L) of a ceramic material; a first movable belt (2) comprising an active portion (3) arranged at least partially between the upper punch (11) and the lower punch (10); a second movable belt (4) comprising an active portion (5) arranged at least partially between the first movable belt (2) and the upper punch (13); a shaped profile (6), which is so structured as to at least partially delimit a
(Continued)

pressing chamber, which is detachably associated to the lower punch (10) or to the upper punch (11) in a projecting manner.

12 Claims, 5 Drawing Sheets

(51) Int. Cl.
*B30B 5/06* (2006.01)
*B30B 11/02* (2006.01)

(56) References Cited

U.S. PATENT DOCUMENTS

| | | | | | |
|---|---|---|---|---|---|
| 4,755,252 | A | | 7/1988 | Held | |
| 5,460,764 | A | * | 10/1995 | Held | B29C 70/504 264/123 |
| 6,908,295 | B2 | * | 6/2005 | Thielman | B29C 43/26 425/371 |
| 10,478,995 | B2 | * | 11/2019 | Stefani | B30B 5/06 |
| 10,675,778 | B2 | * | 6/2020 | Stefani | B30B 5/06 |

FOREIGN PATENT DOCUMENTS

| | | | |
|---|---|---|---|
| CN | 1785632 | | 6/2006 |
| CN | 102303357 | | 1/2012 |
| DE | 2244449 | A1 | 4/1974 |
| EP | 0150048 | A2 | 7/1985 |
| EP | 0793565 | A1 | 9/1997 |
| EP | 0793565 | B1 | 3/2003 |
| EP | 1136212 | | 1/2004 |
| EP | 1500480 | A2 | 1/2005 |
| EP | 1669177 | A2 | 6/2006 |
| EP | 1500480 | | 3/2008 |
| EP | 1500480 | B1 | 3/2008 |
| EP | 1669177 | | 8/2014 |
| RU | 2087307 | C1 | 8/1997 |
| SU | 73398 | A1 | 11/1947 |
| WO | 9615888 | A1 | 5/1996 |

* cited by examiner

FORMING ELEMENT FOR CERAMIC ARTICLES

FIELD OF THE INVENTION

The present invention relates to a forming element for pressing ceramic products, in particular slabs, tiles and the like.

The invention further relates to a pressing device for ceramic products.

DESCRIPTION OF RELATED

The invention relates in particular to a device for pressing ceramic products, invented by the same applicant and known in the sector from publication EP150048, in which the power material to be pressed is arranged in the form of a layer on a rest plane constituted by the upper face of a continuous conveyor belt which is supported slidably on a pressing member or lower punch. The pressing is carried out with a pressing member or upper punch by means of interposing a continuous belt, loop-closed, the external surface whereof is facing towards the continuous conveyor belt.

With the aim of perimetrally limiting a pressing zone, the upper punch is provided with a frame that projects downwards. Beyond perimetrally delimiting the pressing zone, the forming frame also has the task of generating, following the pressing, an edge of the final pressed product characterised by a greater compaction or density than the internal zones.

The device at present available, while being effective and giving a good performance, can be improved in flexibility with respect to a format change of the products to be pressed. In the presently available device, in fact, the format change of the ceramic product requires changing the upper punch with a punch provided with a frame conformed for carrying out the pressing in the new format. This represents a drawback from the point of view of both the working times, as the replacement of the upper punch requires a not-inconsiderable amount of time, and from the point of view of costs, as the upper punch provided with the forming frame is a rather expensive element.

The aim of the present invention is to provide a pressing device that enables obviating the drawbacks of the currently available devices.

An advantage of the pressing device according to the present invention is to enable a format change in significantly shorter times than with the devices at present available.

A further advantage of the pressing device according to the present invention is to reduce the costs necessary for enabling a format change of the products to be pressed.

BRIEF DESCRIPTION OF THE DRAWINGS

Further characteristics and advantages of the present invention will become more apparent in the following detailed description of an embodiment of the present invention, illustrated by way of non-limiting example in the attached figures, in which:

FIG. 1 a illustrates a schematic and vertical elevation view of the device according to the present invention, in a further embodiment thereof;

DETAILED DESCRIPTION OF PREFERRED EMBODIMENTS OF THE INVENTION

Figure 1:
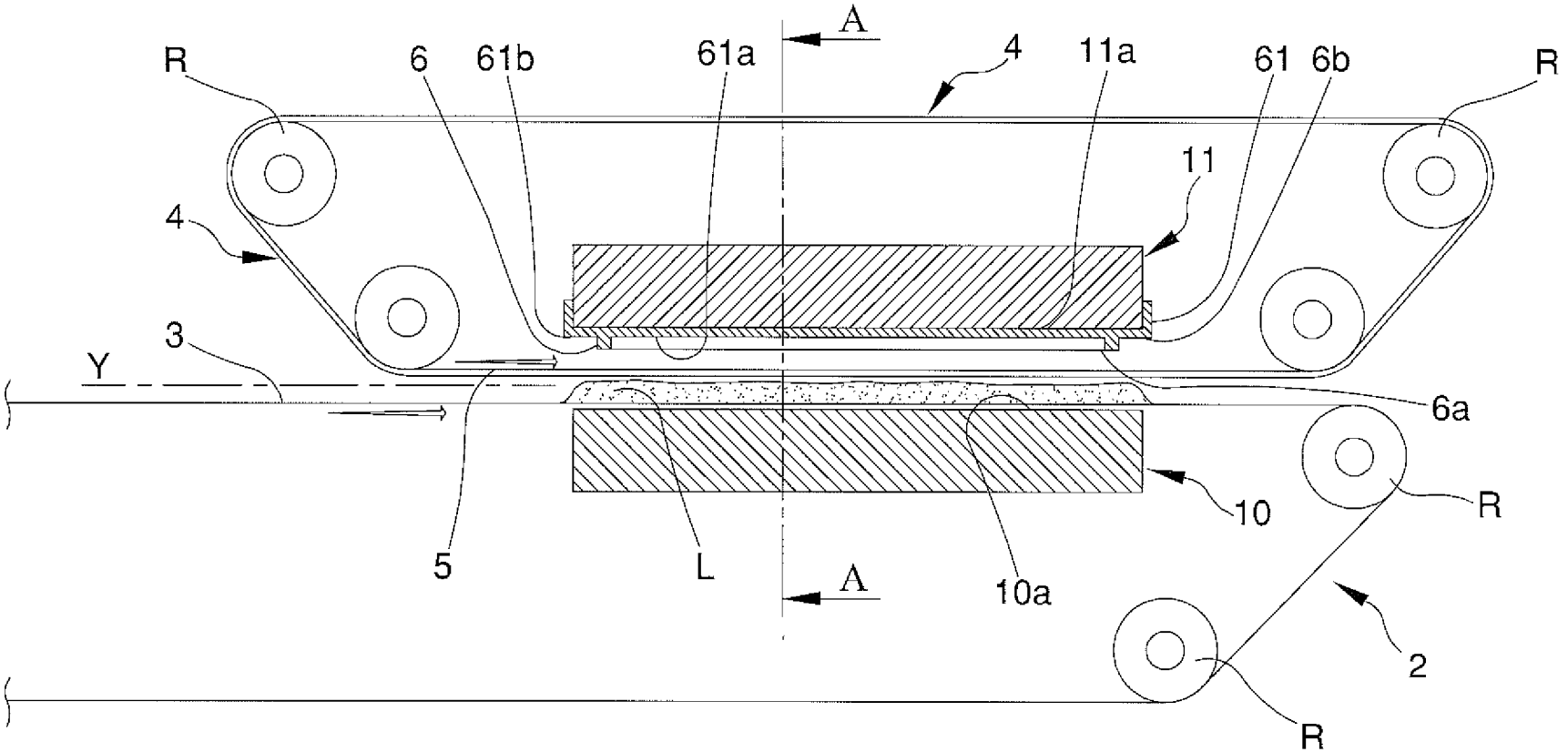
FIG. 1 illustrates a schematic and vertical elevation view of the device according to the present invention.
Figure 1A:
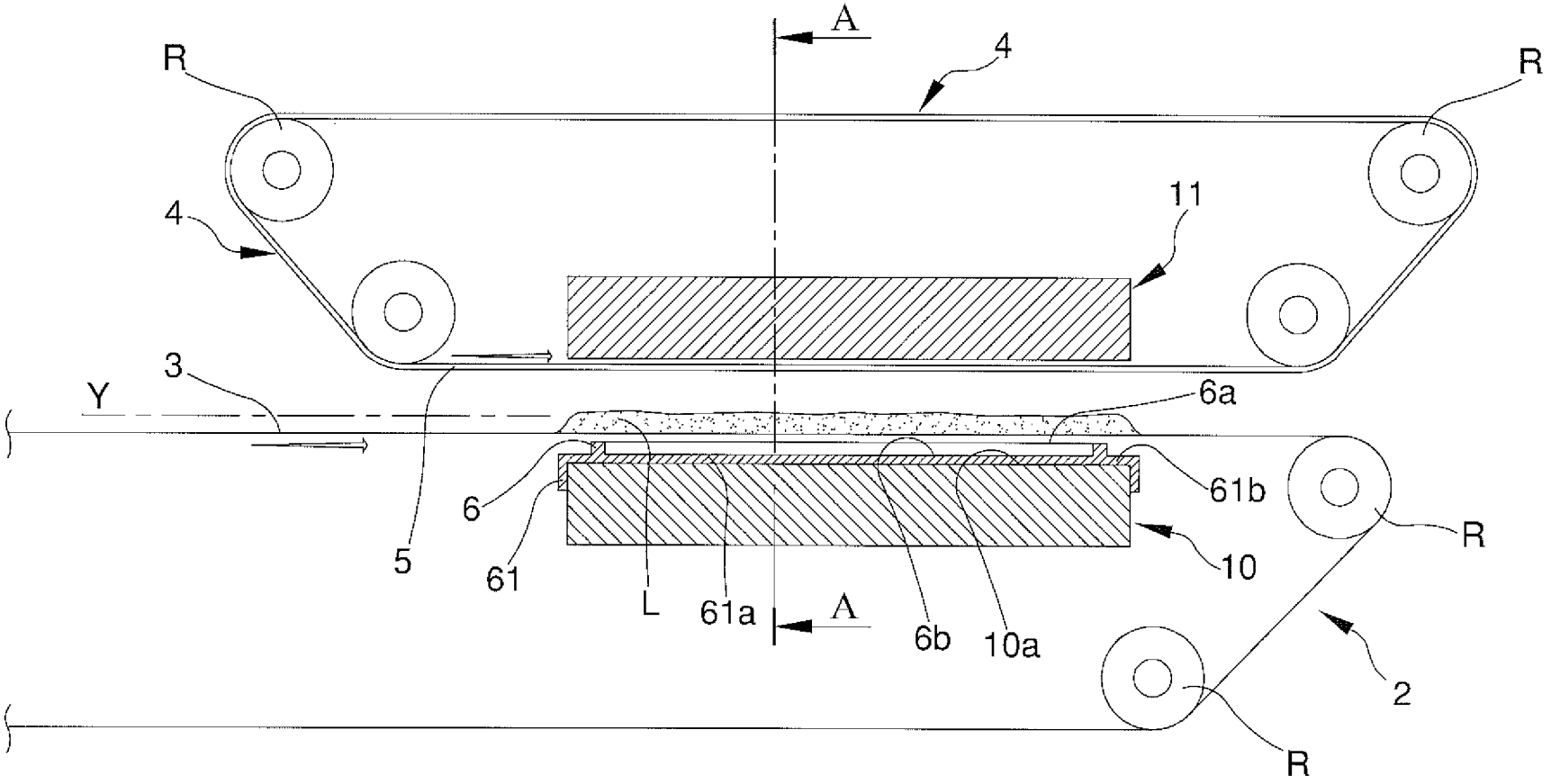

The pressing device of the present invention comprises a lower punch (10), provided with a pressing surface (10*a*) facing upwards, and an upper punch (11) provided with a pressing surface (11*a*) facing downwards. The two punches are part of a press, not illustrated in detail, by which press they are activated reciprocally nearingly and distancingly so as to carry out the pressing of a deposited load (L) of a layer of ceramic material.

The device further comprises a first movable belt (2), which has an active portion (3) provided with a rest surface facing upwards. The active portion (3) is at least partially arranged between the upper punch (11) and the lower punch (10). The first movable belt (2) is thus arranged with the active portion (3) thereof above the lower punch (10) and below the upper punch (11). The active portion (3) of the first belt (2) is mobile along a forward direction (Y) for feeding the layers (L) of material to be pressed into the space comprised between the two punches (10, 11). The loads (L) to be pressed are deposited on the first belt (2) upstream of the two punches, using known means to the expert in the sector and not illustrated in detail. The first belt (2) is activated by means of rollers (R) arranged in relation to the pathway to be following, in a known way in the sector. The rollers have been only schematically represented in the figures.

The pressing device preferably comprises a second movable belt (4) provided with an active portion (5) arranged at least partially between the first movable belt (2) and the upper punch (11). The active portion (5) of the second movable belt (4) is mobile along the forward direction (Y) in agreement with the active portion (3) of the first belt (2). At least for a portion arranged at the punches (10, 11), and partially upstream and downstream thereof, the two active portions (3, 5) are both parallel to the forward direction (Y). The second belt (4) is also activated by means of rollers (R) arranged in relation to the pathway to be followed, in a known way in the sector. The rollers have been only schematically represented in the figures. The second belt (4) can be made up of distinct portions connected to one another. The distinct portions can be identical or different to one another. For example, the second belt (4) can be made up of three distinct portions (not illustrated).

During the feeding of a load (L) to the press (10, 11), the movable belts (2, 4) move at a same velocity. The alignment and synchrony between the movable belts (2, 4) can be obtained in a known way via a retroactive control. During this step the punches (10, 11) are separated by a greater distance to allow inlet of the load (L) into the space comprised between the punches. In this configuration the active portions (3, 5) are parallel to one another and are separated by a distance which enables infeed of the load (L), the thickness of which measured perpendicularly to the rest surface of the lower active portion (3) is smaller than the distance separating the active portions (3, 5).

The pressing device of the invention comprises a shaped profile (6), structured for at least partially delimiting a pressing chamber. The shaped profile (6) can be arranged projecting from the pressing surface (10*a*) of the lower punch (10) or from the pressing surface (11*a*) of the upper punch (11). In the first case, the shaped profile (6) can be interposed between the active portion (3) of the first movable belt (2) and the lower punch (10). In the second case, the shaped profile (6) can be interposed between the active portion (5) of the second movable belt (4) and the upper punch (11). In a preferred embodiment, the shaped profile (6) protrudes downwards with respect to the pressing surface (11*a*) of the upper punch (11). The shaped profile (6) can be interposed between the upper punch (11) and the active portion (5) of the second belt (4). In this way, the shaped profile (6) does not enter into contact with the load (L), while always staying clean. The second belt (4), at the end of the pressing step, is advanced without jolts due to a pre-tensioning, so as to distance the part of the active portion (5) which entered into contact with the load (L), in order for it to be cleaned. At the same time a consecutive portion of the second belt (4), which has already undergone the cleaning operations, takes the place of the preceding portion below the shaped profile (6) according to an advancement cycle synchronised with the belt (2).

Figure 3:
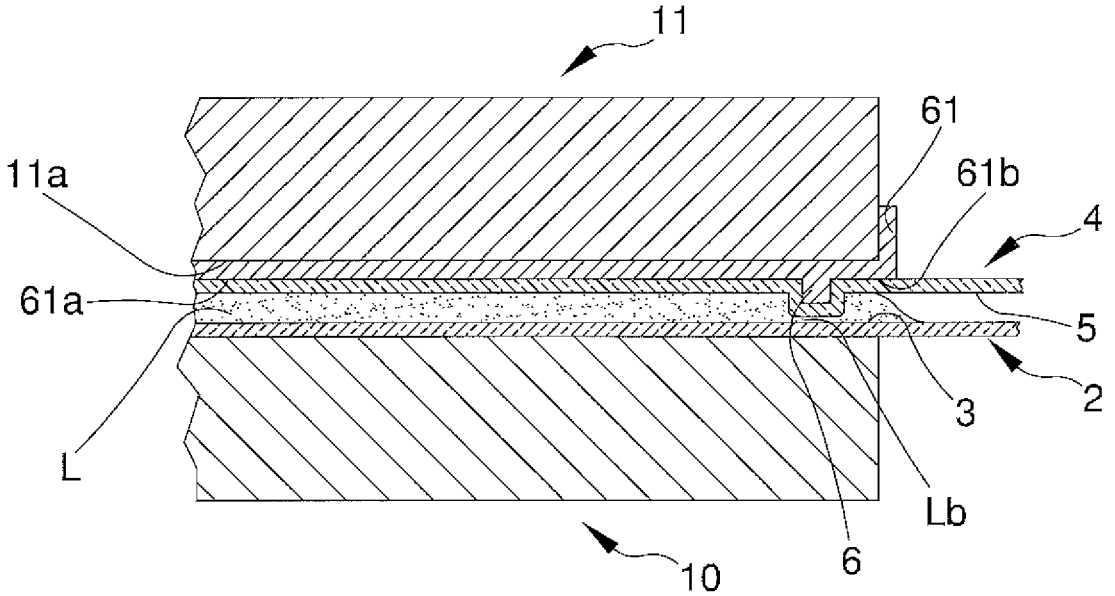
FIG. 3 shows the zone in FIG. 2 in a pressing step.

As can easily be observed in FIG. 3, and as is known to the expert in the sector, the shaped profile (6) produces, during the pressing step, a greater compaction of the load (L) in the zone (Lb) underlying the shaped profile (6). This is because during the pressing step the distance between the lower surface of the shaped profile (6) and the pressing surface (10*a*) of the lower punch (10) is smaller than the distance between the pressing surfaces (10*a*, 11*a*) of the two punches (10, 11) in the whole zone where the shaped profile (6) is not present. In substance the material pressed by the shaped profile (6) acquires a greater density, preventing formation and propagation of cracks.

The shaped profile (6) overall delimits the border of the product, tile or slab, which will be obtained at the end of the production cycle. The zone of the border of the product, pressed by the shaped profile (6), has a greater density and a greater compaction. This facilitates the detaching of the material externally of the border zone, i.e. the material that has not been pressed by the shaped profile (6). The detaching of the external material carried out in a known way by means of appropriate devices which trim the edge of the product.

The shaped profile (6) is preferably in the shape of a frame which defines a closed border on a plane parallel to the pressing surfaces (10*a*, 11*a*) of the punches (10,11). For example the shaped profile (6) can define a rectangular or square border, but can also be polygonal, or an open border or only some sides of the border.

While in machines at present available the shaped profile (6) is solidly constrained to the pressing surface (11*a*) of the upper punch (11), in the device according to the invention the shaped profile (6) is detachably associated to the upper punch (11). This leads to the very significant advantage of maintaining the same upper punch (11) for obtaining products having different formats, while replacing only the shaped profile (6). As will be easily understandable, the change operation of the shaped profile (6) is considerably more rapid and more economical with respect to a punch change operation. In the embodiment described and represented, the shaped profile (6) is associated to the upper punch (11), but alternatively it might be associated to the lower punch (10).

Figure 6:
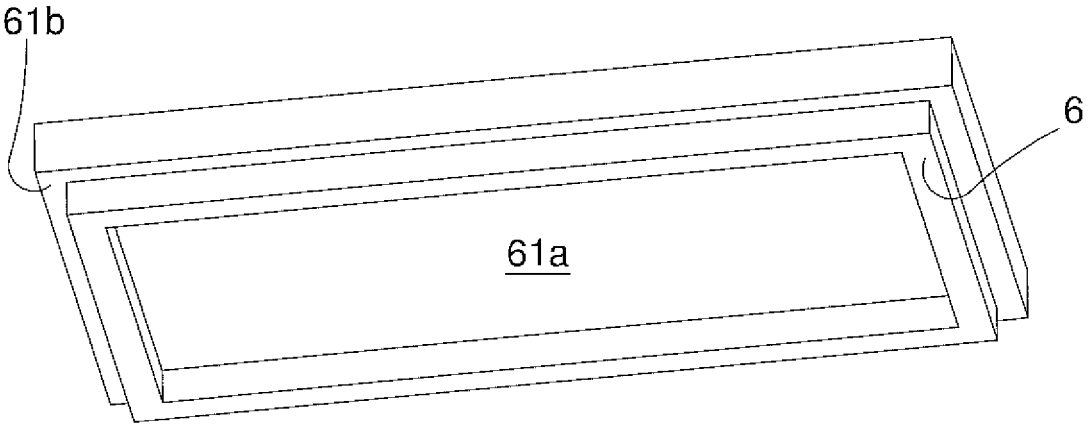
FIG. 6 is an axonometric view of the forming element according to the present invention.

As it is visible in FIG. 6, in a preferred embodiment the shaped profile (6) has, on a section plane perpendicular to the pressing surfaces (10*a*, 11*a*), a rectangular or square section. Sections of different shape are also possible. The shape and size of the surface of the shaped profile (6) facing downwards, and therefore destined to enter into contact with the second belt (4) for pressing the load (L), influence the degree of compaction and density reached by the material to be pressed at the end of the pressing step. The choice of a flexible and elastically deformable material for the realisation of the shaped profile (6) enables exerting a pressure that is substantially uniform in the zone underlying the shaped profile (6).

The shaped profile (6) is overall tangent to a front plane (6*a*) that during the pressing step is parallel to the pressing surface (11*a*) of the upper punch (11) and to the pressing surface (10*a*) of the lower punch (10). In other terms, the front plane (6*a*) of the shaped profile (6) is tangent to the external surface of the shaped profile (6) in the more downwards-projecting zones, i.e. in the zones destined to enter into contact first with the active portion (5) of the second belt (4) during the pressing step. In a case where the shaped profile (6) is associated to the lower punch (10), the front plane (6*a*) of the shaped profile (6) is tangent to the external surface of the shaped profile (6) in the more upwards-projecting zones, i.e. in the zones destined to enter into contact first with the active portion (3) of the first belt (2) during the pressing step. The shaped profile (6) projects from a base plane (6*b*) that overall during the pressing step is parallel to the pressing surface (11*a*) of the upper punch (11) and to the pressing surface (10*a*) of the lower punch (10).

In a possible embodiment, the shaped profile (6) is associated with a support (61), which is removably associable to the upper punch (11). The support (61) overall defines the base plane (6*b*) of the shaped profile (6) and extends internally and externally of the border delimited by the shaped profile (6). In a first embodiment, an inner part (61*a*) of the support (61), delimited within the shaped profile (61), is located at a same distance from the front plane (6*a*), at which distance the outer part of the support (61*b*) is also located, i.e. the part which remains external of the shaped profile (61). In an alternative embodiment, the inner part (61*a*) is located at a shorter distance from the front plane (6*a*) compared to the outer part (61*b*). In other terms, in this alternative embodiment the inner part (61*a*) is less contained internally of the shaped profile (6) with respect to the first embodiment. This enables giving, to the part of the load (L) that remains external of the shaped profile (6), a compaction and a density that are lower than the part delimited internally of the shaped profile (6).

Figure 7:
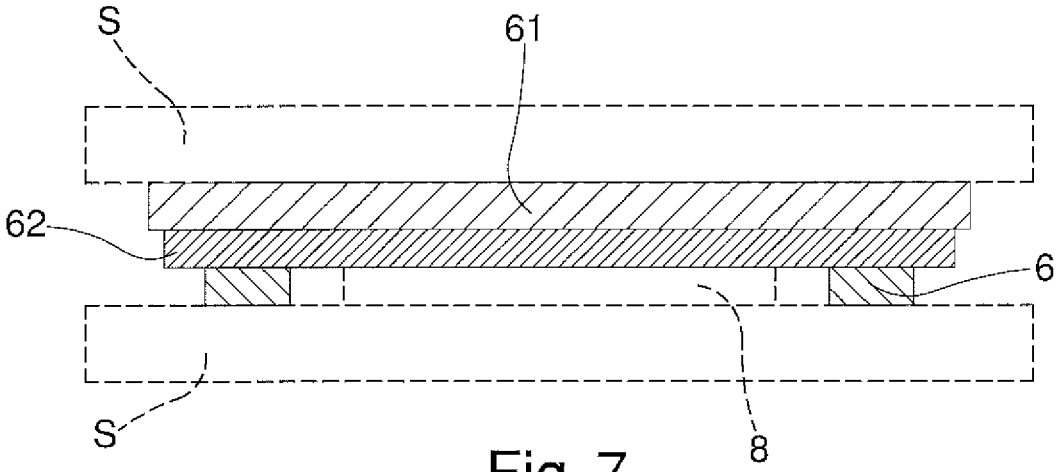
FIG. 7 is a second possible embodiment of the forming element according to the present invention, viewed in a section plane perpendicular to the forward direction (Y).

In a possible alternative embodiment, shown in FIG. 7, one or more layers of covering (62) are associated to the support (61), for example by gluing. The shaped profile (6) is associated to the covering layer (62) (or the most external between the covering layers), for example by gluing. Both the frame (6) and the covering layer (62) enter into contact with the load (L).

The embodiment comprising the covering layer (62) can be obtained in the following way.

The covering layer (62) can be associated to the support (61) for example by gluing, with the aid of a punch (S) for maintaining the planarity of the support (61).

Thereafter it is possible to apply the shaped profile (6) by interposing a layer of glue between the profile and the covering layer (62).

At this point, the group formed by the support (61), the shaped profile (6) and the covering layer (62) can be pressed, preferably by laying a temporary plate (B) in the zone delimited by the shaped profile (6). The temporary plate (B) and the two punches (S) for carrying out the pressing are schematically represented in FIG. 7 in a broken line.

Figure 8:
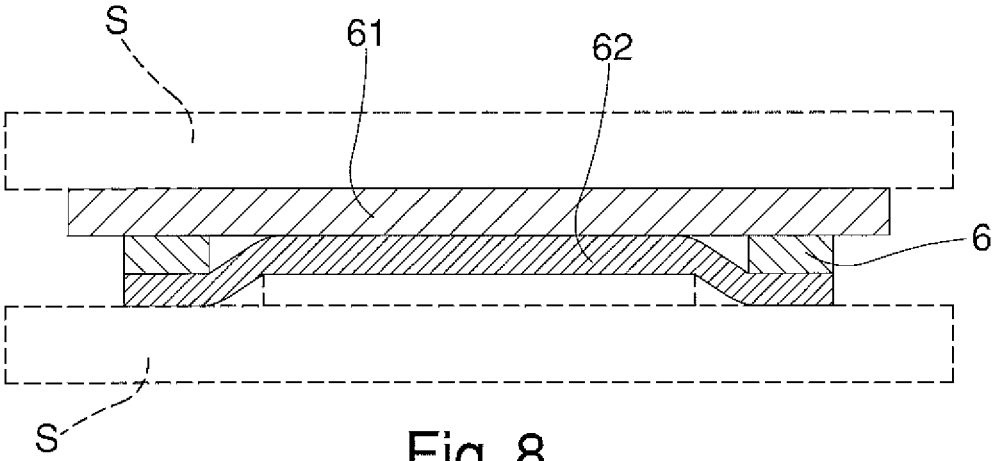
FIG. 8 is a further possible embodiment of the forming element according to the present invention, viewed in a section plane perpendicular to the forward direction (Y).

In a further alternative embodiment, shown in FIG. 8, the shaped profile (6) is applied to the support (61), to which one or more covering layers (62) are associated. At least a covering layer (62) overlaps, at least partially, the shaped profile (6), so that the shaped profile (6) is comprised between the support (61) and the covering layer (62). In particular, a central portion of the covering layer (62) is associated, for example by gluing, to the support (61), while a peripheral portion of the covering layer (62) is associated to the shaped profile (6). In this embodiment it is the covering layer (62) that enters into contact with the load (L).

In the zone located in proximity of the internal edge of the shaped profile (6), the covering layer (62), assumes a partially curved or rounded configuration. In this way, the shaped profile (6) exerts its pressing action without presenting live edges, or in any case with limited radii of curvature, in contact with the load (L).

The embodiment comprising the covering layer (62) can be obtained in the following way.

The covering layer (62) can be associated to the support (61) in a central zone, for example by gluing, while maintaining a peripheral zone of the covering layer (62) dissociated from the support (61).

Thereafter it is possible to insert the shaped profile (6) between the support (61) and the peripheral zone of the covering layer (62), interposing a layer of glue both in the interface between the shaped profile (6) and the support (61), and in the interface between the shaped profile (6) and the covering layer (62).

At this point, the group formed by the support (61), the shaped profile (6) and the covering layer (62) can be pressed, preferably by laying a temporary plate (B) in the zone delimited by the shaped profile (6). The temporary plate (B) and the two punches (S) for carrying out the pressing are schematically represented in FIG. 7 in a broken line.

Both the shaped profile (6) and the support (61) are preferably made of a flexible material, for example of a type usable for realising conveyor belts or the like. The support (61) can for example be in the form of a flexible carpet to which the shaped profile (6) is applied. The support (61) and the shaped profile (6) can be obtained in a known way by gluing and/or welding of a plurality of sheets of a material suitable for the purpose.

Figure 2:
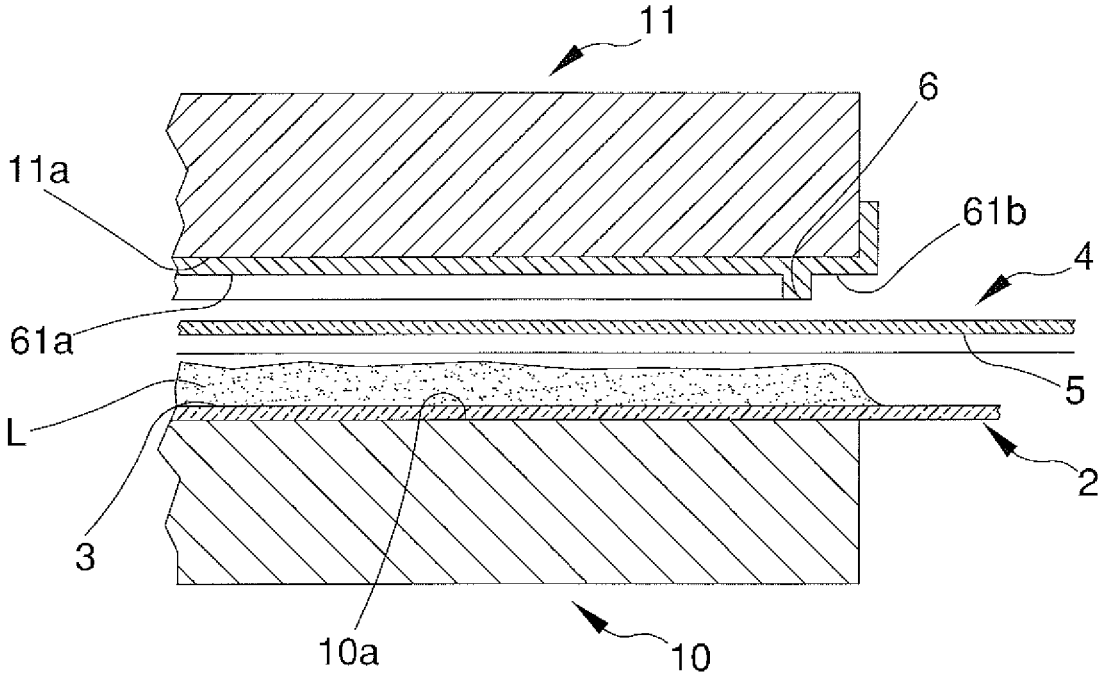
FIG. 2 illustrates a zone of the device of FIG. 1 in larger scale.

The fixing of the support (61) to the upper punch (11) can be done by means of devices of various nature within the scope of a technical expert in the sector. For example, the support (61) can be detachably constrained to lateral surfaces of the upper punch (11) by means of removable devices positioned along peripheral or border zones of the support (61). The flexibility of the support (61) facilitates the mounting and demounting operations. The flexibility of the support (61) further means that during the feeding step of the load (L) and in the positions of the punches (10, 11) in which the shaped profile (6) is not pressed in contact with the second belt (4) and/or the load (L) (FIG. 2), the support (61) can take on a bellied configuration and be partially detached from the pressing surface (11*a*) of the upper punch (11).

In the pressing position and in the positions close to the pressing position (FIG. 3), the shaped profile (6) is pressed in contact with the active portion (5) of the second belt (4) which in turn deforms assuming overall the shape of the shaped profile (6).

Figure 4:
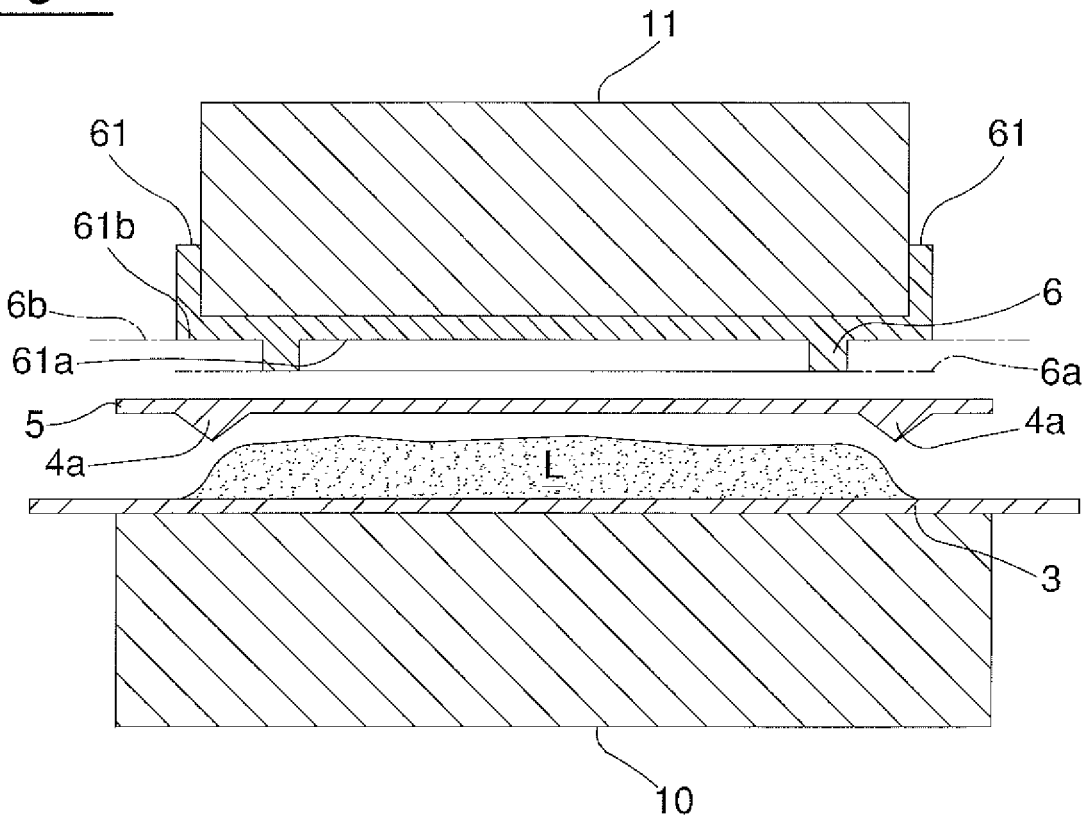
FIG. 4 shows a section view according to plane A-A of FIG. 1.
Figure 5:
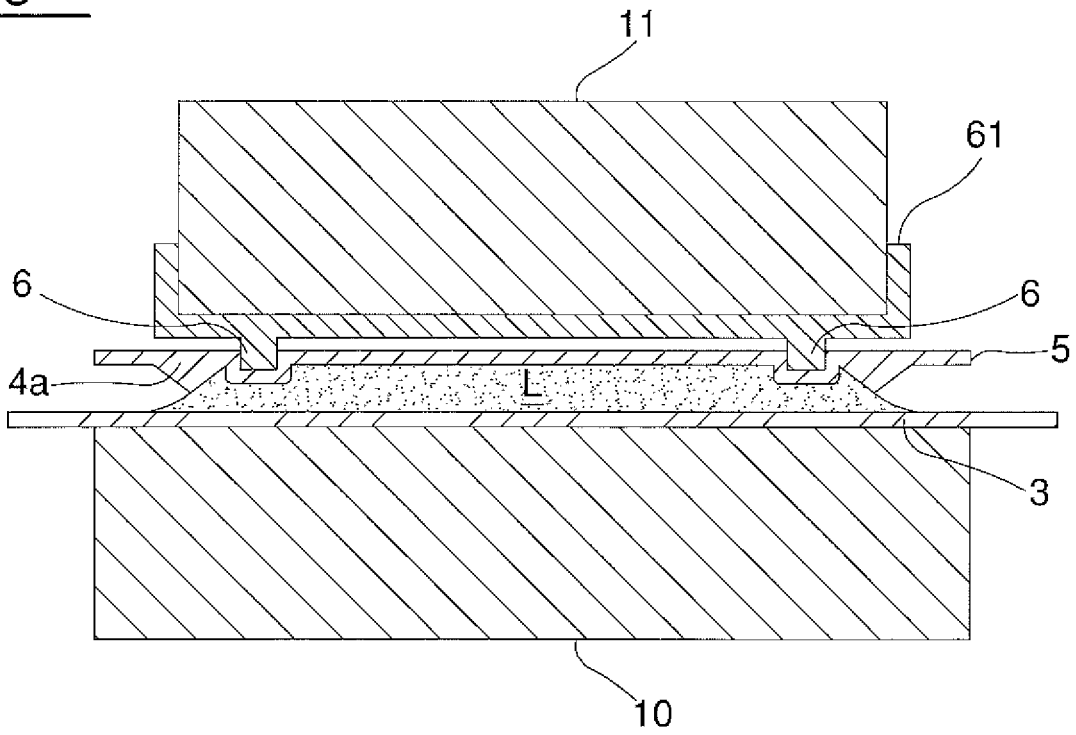
FIG. 5 shows the device of FIG. 4 in a pressing step.

In a particularly advantageous embodiment (FIGS. 4 and 5) the second movable belt (4) is provided with two protruding edges (4*a*), that in the active portion (5) are directed towards the active portion (3) of the first movable belt (2) and are parallel to a forward direction (Y). The protruding edges (4*a*) are located outside the shaped profile (6), as shown in FIGS. 4 and 5. In other terms, on a section plane perpendicular to the forward direction (Y), the shaped profile (6) is comprised between the protruding edges (4*a*). The function of the protruding edges (4*a*) is to laterally contain the load (L) so that, during the pressing step, it does not escape laterally to the first belt (2). The protruding edges (4*a*) preferably have, on a section plane perpendicular to the forward direction (Y), a section having a tapered shape with an apex directed downwards.

The pressing device of the present invention attains all the set aims.

The use of a shaped profile (6) detachably associated to the upper punch (11) enables realising format changes in significantly shorter times with respect to the devices at present available; it is in fact sufficient to replace the shaped profile (6) instead of the whole punch, as is instead necessary with the devices at present available. The possibility of replacing only the shaped profile (6) further enables reducing the overall costs necessary for enabling a format change request, as it avoids the need to have available an equal number of punches.

The invention claimed is:

1. A pressing device for pressing a product of ceramic material, comprising:

a lower punch (10), provided with a pressing surface (10*a*) facing upwards;

an upper punch (11) provided with a pressing surface (11*a*) facing downwards; at least one of the two punches is movable towards and away relative to the other in order to perform pressing of a layer (L) of the ceramic material to form the product of ceramic material;

a first movable belt (2) comprising an active portion (3) arranged at least partially between the upper punch (11) and the lower punch (10);

a second movable belt (4) comprising an active portion (5) arranged at least partially between the first movable belt (2) and the upper punch (11);

characterized by comprising a shaped profile (6), which is so structured as to at least partially delimit a pressing chamber which is configured to form the product of ceramic material, which is the shaped profile (6) being detachably associated to the lower punch (10) or to the upper punch (11) in a projecting manner, wherein the shaped profile (6) is associated with a support (61) which is removably associated to the upper punch (11) or to the lower punch (10), the pressing chamber being at least partially defined by a perimeter which extends so that, during operation of the pressing device, a depression defining an edge is formed around a perimeter of the product of ceramic material being pressed.

2. A pressing device according to claim 1, wherein the shaped profile (6) and the support (61) are made at least partially of flexible material.

3. A pressing device according to claim 2, wherein the shaped profile (6) is removably associated to the upper punch (11) and protrudes downwards with respect to the upper punch (11).

4. A pressing device according to claim 3, wherein the shaped profile (6) is overall tangent to a front plane (6*a*) that during the pressing step is parallel to the pressing surface (11*a*) of the upper punch (11); an inner part (61*a*) of the support (61), delimited within the shaped profile (6), is located at same distance from the front plane (6*a*), at which distance the outer part (61*b*) of the support (61) is also located.

5. A pressing device according to claim 3, wherein the shaped profile (6) is overall tangent to a front plane (6*a*) that during the pressing step is parallel to the pressing surface (11*a*) of the upper punch (11); an inner part (61*a*) of the support (61), delimited within the shaped profile (6), is located at a different distance from the front plane (6*a*) compared to the distance at which the outer part (61*b*) of the support (61) is located.

6. A pressing device according to claim 2, comprising a coating covering layer (62), which is associated to the support (61) to which the shaped profile (6) is applied.

7. A pressing device according to claim 2 comprising a covering layer (62) associated to the support (61), which is at least partially overlapped to the shaped profile (6).

8. A pressing device according to claim 1, wherein the shaped profile (6) is made of at least partially flexible and elastically deformable material.

9. A pressing device according to claim 1, wherein the shaped profile (6) is in the form of a frame.

10. A pressing device according to claim 1, in which the second movable belt (4) is provided with one or two protruding edges (4*a*), that in the active portion (5) are directed towards the active portion (3) of the first movable belt (2) and are parallel to a forward direction (Y).

11. A pressing device according to claim 10, wherein the protruding edges (4*a*) are located outside of the shaped profile (6).

12. A pressing device according to claim 1, wherein the product of ceramic material is a ceramic slab or a ceramic tile.

* * * * *